US008858038B2

(12) United States Patent
Haythornthwaite

(10) Patent No.: US 8,858,038 B2
(45) Date of Patent: Oct. 14, 2014

(54) LIGHTING APPARATUS WITH PEAK/FLAT ADJUSTMENT

(75) Inventor: David Haythornthwaite, Xiamen (CN)

(73) Assignee: Koninklijke Philips N.V., Eindhoven (NL)

( * ) Notice: Subject to any disclaimer, the term of this patent is extended or adjusted under 35 U.S.C. 154(b) by 218 days.

(21) Appl. No.: 13/254,951

(22) PCT Filed: Mar. 3, 2010

(86) PCT No.: PCT/IB2010/050925

§ 371 (c)(1),
(2), (4) Date: Feb. 8, 2012

(87) PCT Pub. No.: WO2010/100616

PCT Pub. Date: Sep. 10, 2010

(65) Prior Publication Data

US 2012/0127737 A1 May 24, 2012

Related U.S. Application Data

(60) Provisional application No. 61/158,107, filed on Mar. 6, 2009.

(30) Foreign Application Priority Data

Mar. 6, 2009 (AU) ..... 2009200880

(51) Int. Cl.
*F21V 19/02* (2006.01)

(52) U.S. Cl.
CPC ..... *F21V 19/02* (2013.01)
USPC ..... 362/372; 362/324; 362/319; 362/368; 362/188; 362/408; 362/418; 362/428; 362/429

(58) Field of Classification Search
USPC ..... 363/368; 362/368, 324, 319, 188, 372, 362/408, 418, 428, 429
See application file for complete search history.

(56) References Cited

U.S. PATENT DOCUMENTS

| | | | | | |
|---|---|---|---|---|---|
| 1,512,158 | A | * | 10/1924 | Bragg et al. | 362/286 |
| 4,104,709 | A | * | 8/1978 | Kloots | 362/105 |
| 4,306,279 | A | * | 12/1981 | Cohen | 362/365 |
| 4,519,020 | A | * | 5/1985 | Little | 362/268 |
| 4,707,768 | A | * | 11/1987 | Ball | 362/523 |
| 4,729,065 | A | | 3/1988 | Bahnemann | |
| 4,729,077 | A | | 3/1988 | Gordin | |
| 4,987,523 | A | * | 1/1991 | Lindabury et al. | 362/188 |
| 5,029,058 | A | * | 7/1991 | Hirose et al. | 362/288 |
| 5,171,086 | A | * | 12/1992 | Baloochi | 362/188 |
| 5,458,035 | A | * | 10/1995 | Okamura | 84/293 |
| 5,865,525 | A | * | 2/1999 | Kibler et al. | 362/187 |
| 6,021,547 | A | * | 2/2000 | Stagoll | 16/105 |

(Continued)

FOREIGN PATENT DOCUMENTS

WO 2008041870 A2 4/2008

*Primary Examiner* — Thomas A Hollweg

(57) ABSTRACT

The present invention relates to a lighting apparatus (1) or assembly therefore comprising: a carriage (25) coupled to a housing (10*a*, 10*b*), the carriage (25) adapted to retain a lamp (14) within the housing, the carriage (25) being moveable relative to the housing (10*a*, 10*b*) to manipulate the position of the lamp (14) within the housing (10*a*, 10*b*), wherein the carriage (25) is moveable along a first axis by way of a force applied along a second axis. This provides a more convenient way of adjusting the peak/flat of the light apparatus.

4 Claims, 7 Drawing Sheets

(56) References Cited

U.S. PATENT DOCUMENTS

| | | | | |
|---|---|---|---|---|
| 6,164,635 | A * | 12/2000 | Chase et al. | 269/244 |
| 6,174,071 | B1 * | 1/2001 | Chan | 362/187 |
| 6,179,448 | B1 * | 1/2001 | Johnson et al. | 362/285 |
| 6,206,539 | B1 * | 3/2001 | Ko | 362/157 |
| 6,290,373 | B1 * | 9/2001 | Dwight et al. | 362/285 |
| 6,354,722 | B1 * | 3/2002 | Montenegro et al. | 362/514 |
| 6,877,876 | B1 * | 4/2005 | Steinhilber | 362/188 |
| 7,431,482 | B1 * | 10/2008 | Morgan et al. | 362/364 |
| 2006/0250788 | A1 * | 11/2006 | Hodge et al. | 362/147 |
| 2010/0103685 | A1 * | 4/2010 | Austin | 362/366 |

* cited by examiner

LIGHTING APPARATUS WITH PEAK/FLAT ADJUSTMENT

FIELD OF THE INVENTION

The present invention relates to a peak/flat adjustment assembly for lighting apparatus, such as luminaires, architectural lights and the like.

BACKGROUND

Lighting apparatus, such as luminaires and architectural lighting, comprise a cylindrical type housing, which contains a reflector, a lens system and a lamp. A lamp is moveably displaced in the housing such that the illumination is reflected off the reflector and through the lens system to illuminate the desired area.

By adjusting the position of the lamp, it is possible to adjust the peak/flat of the lighting apparatus. Peak/flat adjustments (which are understood by those skilled in the art) relate to the light distribution pattern of a lighting apparatus.

Traditionally, means for manipulating the position of the lamp within the housing to adjust peak/flat have been clumsy.

SUMMARY OF INVENTION

In one aspect the present invention may be said to consist in a lighting apparatus comprising:

a housing, a carriage coupled to the housing, the carriage adapted to retain a lamp within the housing, the carriage being moveable relative to the housing to manipulate the position of the lamp within the housing, wherein the carriage is moveable along a first axis by way of a force applied along a second axis.

Optionally:

the housing is elongated with a longitudinal direction and has a back plate with an aperture, the carriage is moveable relative to the back plate along the longitudinal direction to position a retained lamp in the housing through the aperture.

Optionally the carriage is coupled to the housing via a guide, the carriage being moveable relative to the back plate along the guide.

Optionally the carriage comprises a force diverter, such as a ramp, for transferring a force along the second axis, such as a rotational force, into a force in the longitudinal direction to coerce the carriage in the longitudinal direction. The longitudinal direction may be the central axis of the light apparatus.

Optionally the force diverter comprises a first angled surface that bears against a second angled surface.

Optionally the first angled surface is disposed on the carriage and the second angled surface is disposed on an insert that moves relative to the carriage.

Optionally the force is applied to the insert.

Optionally the force is applied by way of rotating a member threaded into the insert.

In another aspect the present invention may be said to consist in a peak/flat adjustment assembly for a lighting apparatus comprising:

a carriage for coupling to the lighting apparatus, the carriage adapted to retain a lamp within the housing, the carriage being moveable relative to the housing to manipulate the position of the lamp within the housing, wherein the carriage is moveable along a first axis by way of a force applied along a second axis.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

The term "comprising" as used in this specification means "consisting at least in part of". Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

It is an advantage of at least one embodiment of the invention that the user can adjust the plat/peak by applying force not in axis with the desired movement of the lamp. In use, the user is often up a ladder. The user can apply a force at the side of the lighting apparatus rather than the back, making it more convenient and intuitive.

BRIEF DESCRIPTION OF THE DRAWINGS

Embodiments of the invention will be described with reference to the following drawings, of which.

DETAILED DESCRIPTION OF PREFERRED EMBODIMENTS

The peak/flat adjustment assembly forms part of an overall lighting apparatus. For example, the lighting apparatus could be a luminaire or architectural lighting, although the assembly could be used in any suitable lighting apparatus. The peak/flat adjustment assembly can be integrated into an existing lighting apparatus to provide a means to adjust the position of the lamp within the housing to adjust peak/flat. Embodiments include the assembly on its own, or a lighting apparatus comprising the assembly.

One embodiment of the peak/flat adjustment assembly for a lighting apparatus is now described with reference to FIGS. 1-7.

Figure 1:
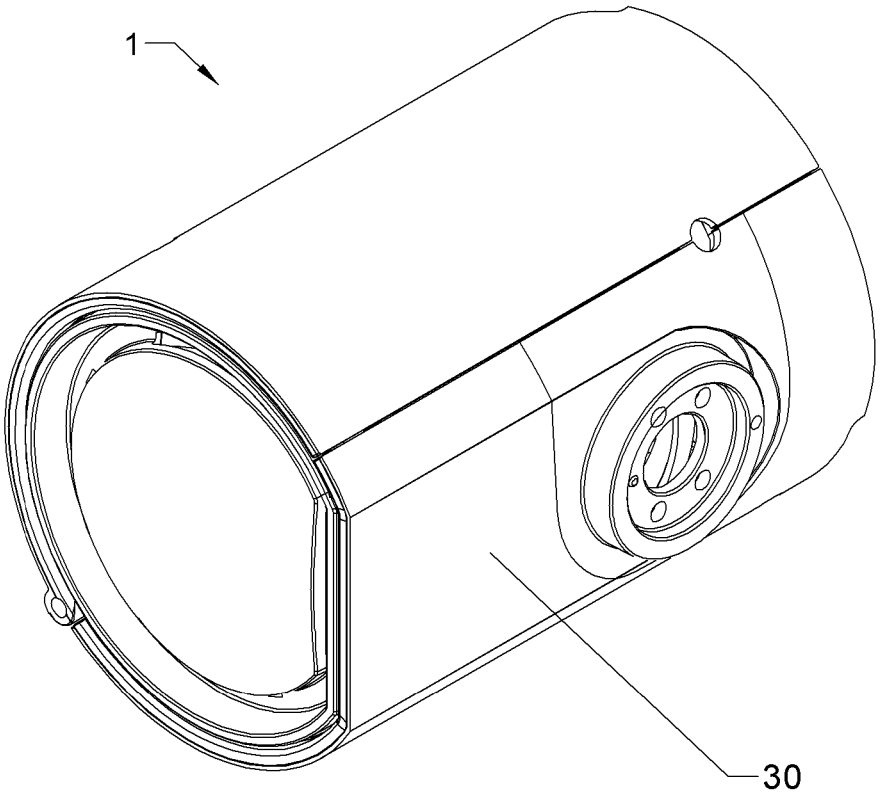
FIG. 1 is a perspective view of a lighting apparatus.

FIG. 1 shows a lighting apparatus 1, in this an instance architectural lighting apparatus. The apparatus 1 comprises a housing 30 being generally cylindrical in shape and having a longitudinal axis and more generally a longitudinal direction L, see FIG. 2. The longitudinal direction extends in both directions along line L. As described in more detail below, the housing 30 retains a peak/flat adjustment assembly, reflector, lamp, lens system and other components of a lighting apparatus.

Figure 2:
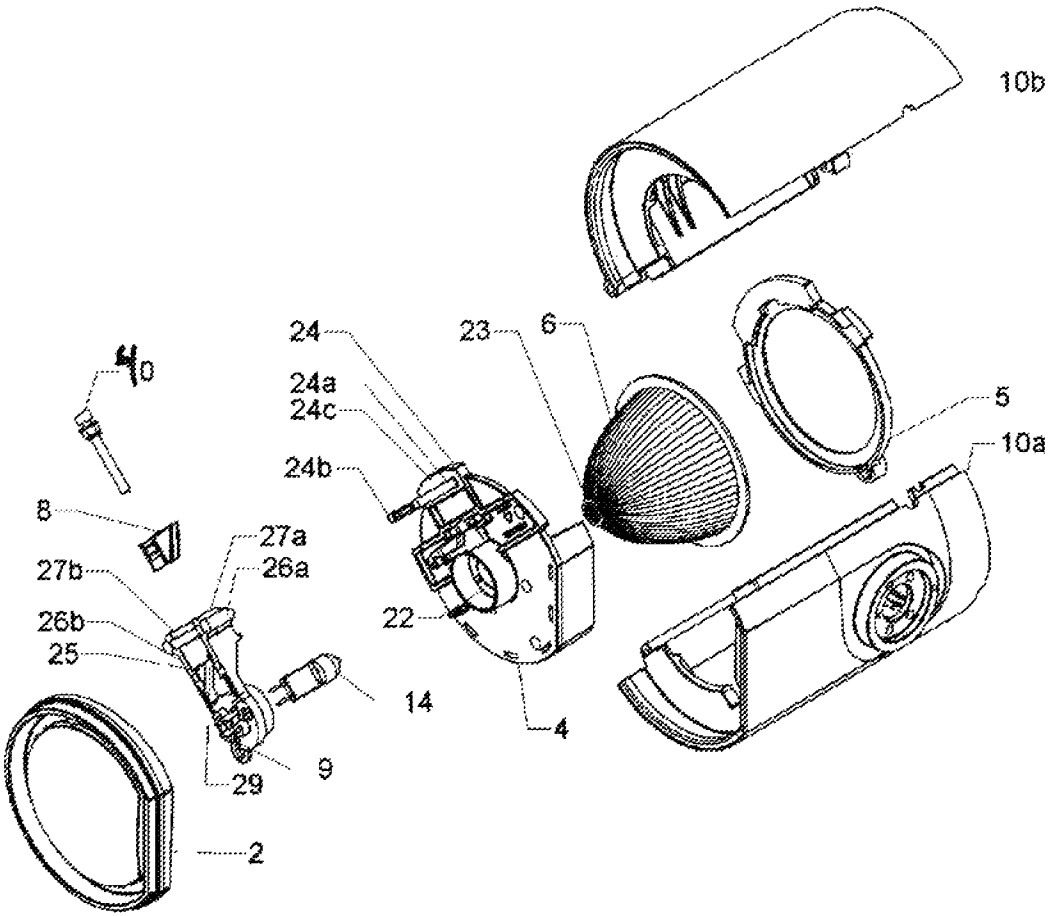
FIG. 2 is an exploded isometric of the lighting apparatus.

FIG. 2 shows the internal components housed in such a lighting apparatus 1. The housing 30 is formed as two half cylindrical components 10*a*, 10*b* that can be coupled together to form the cylindrical assembly of the housing 30. The lamp reflector 6 and reflector holder 5 are retained within the housing 30. The light reflector 6 has an aperture 23 through which a lamp 14 can be inserted when the lighting apparatus 1 is assembled. A lens system (not shown) can also be retained in the housing 30.

A back plate (lamp baffle) 4 is coupled to the cylindrical components 10*a*, 10*b*. Among other things, the baffle 4 provides a mount for the lamp reflector 6. The baffle 4 has an aperture 22 through which the lamp 14 can be inserted. The baffle aperture 22 is aligned coincidentally with the reflector aperture 23. A rear lamp housing 2 encloses the peak/flat adjustment assembly and mechanism.

The baffle 4 has a carriage guide/coupling 24, comprising two rails 24*a*, 24*b*, that extends longitudinally backwards from the back face of the baffle 4. The rails 24*a*, 24*b* are joined by a webbing 24*c*.

Figure 3:
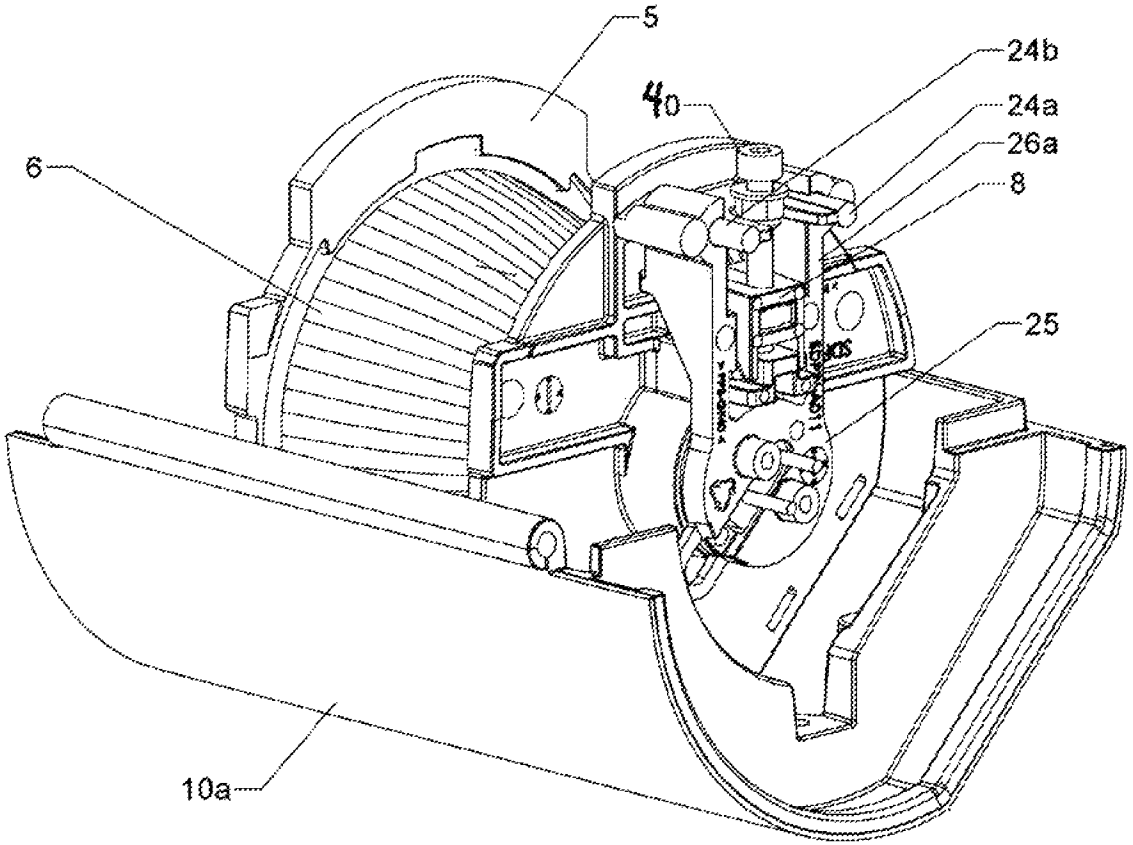
FIGS. 3-5 are perspective views of a carriage in further detail.
Figure 4:
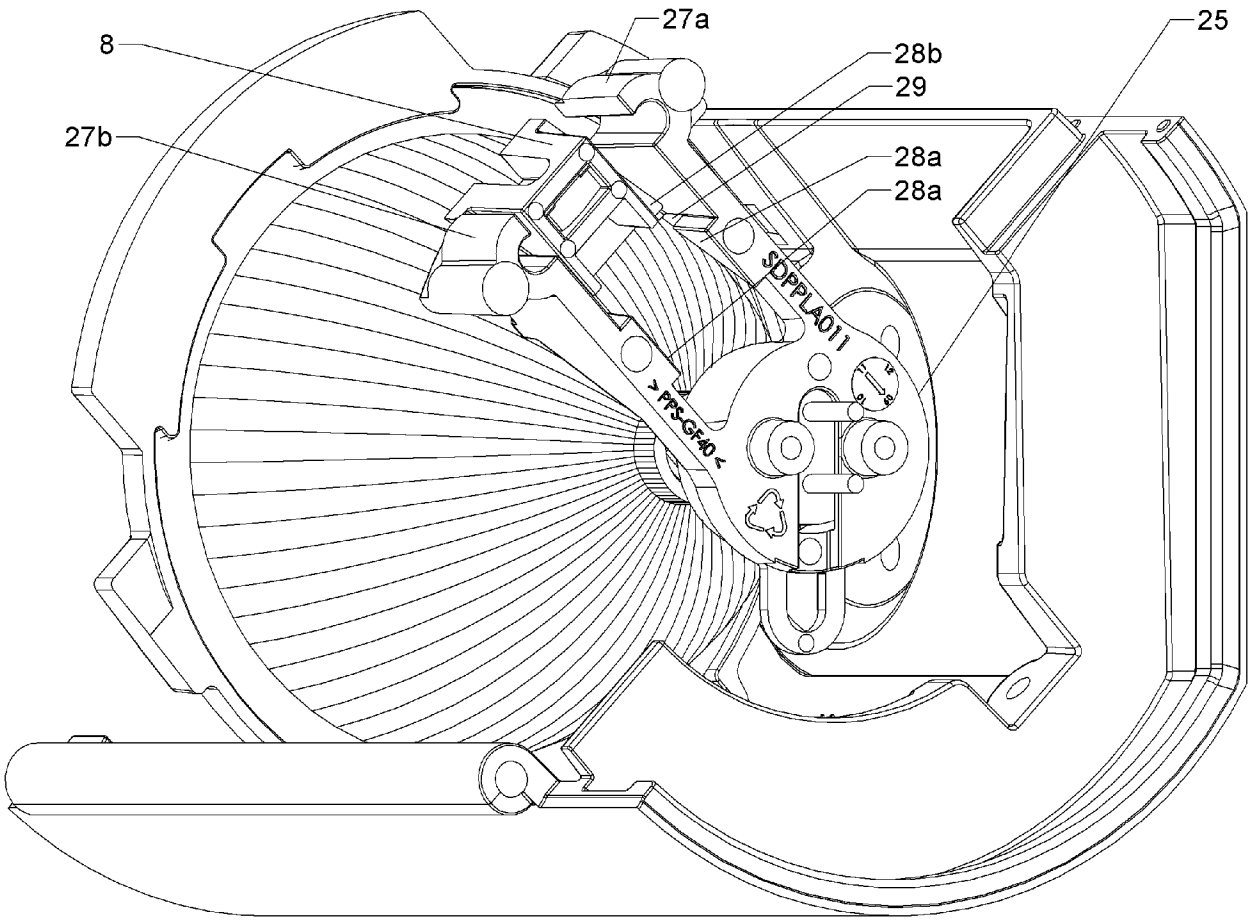
Figure 5:
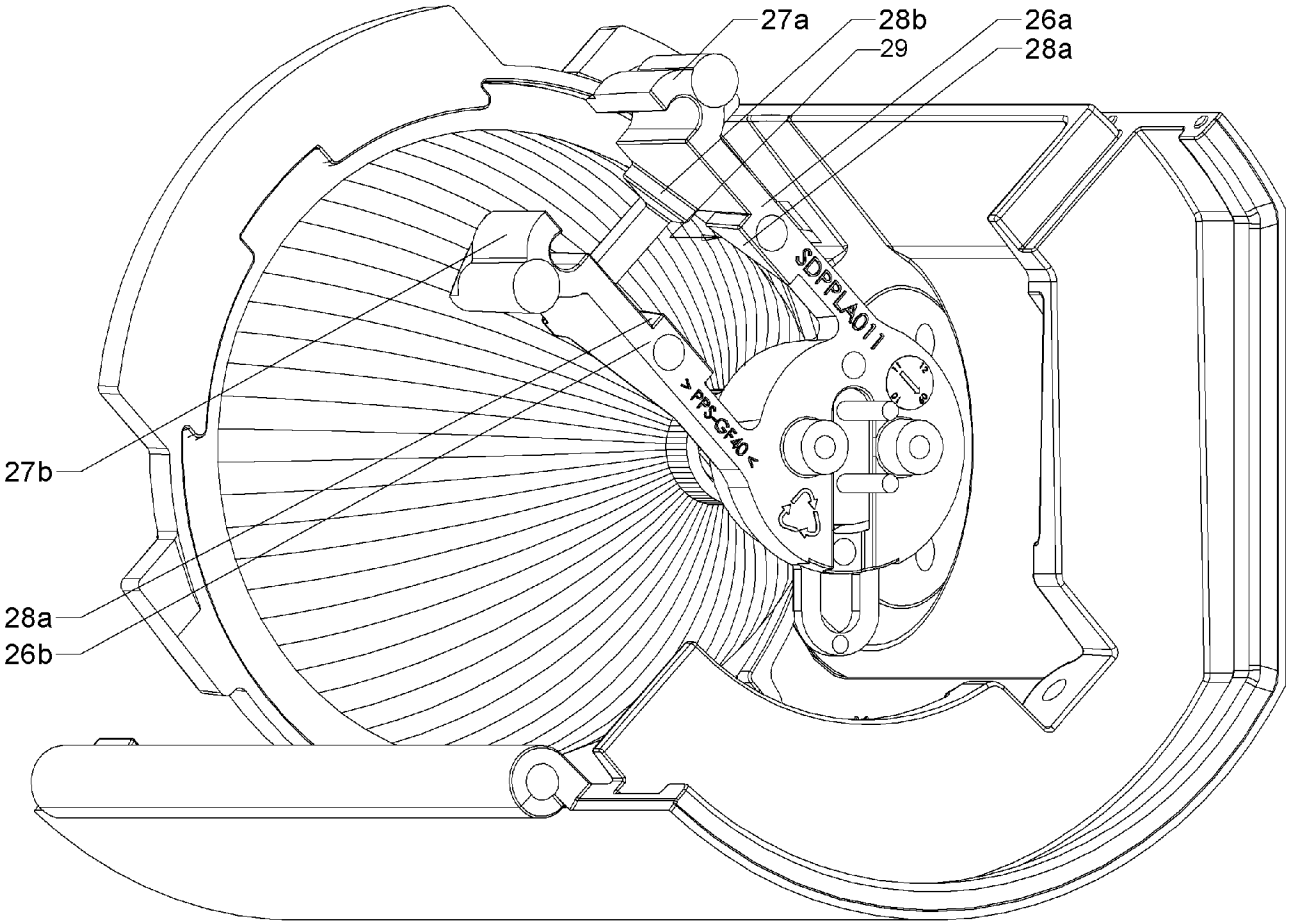
Figure 6:
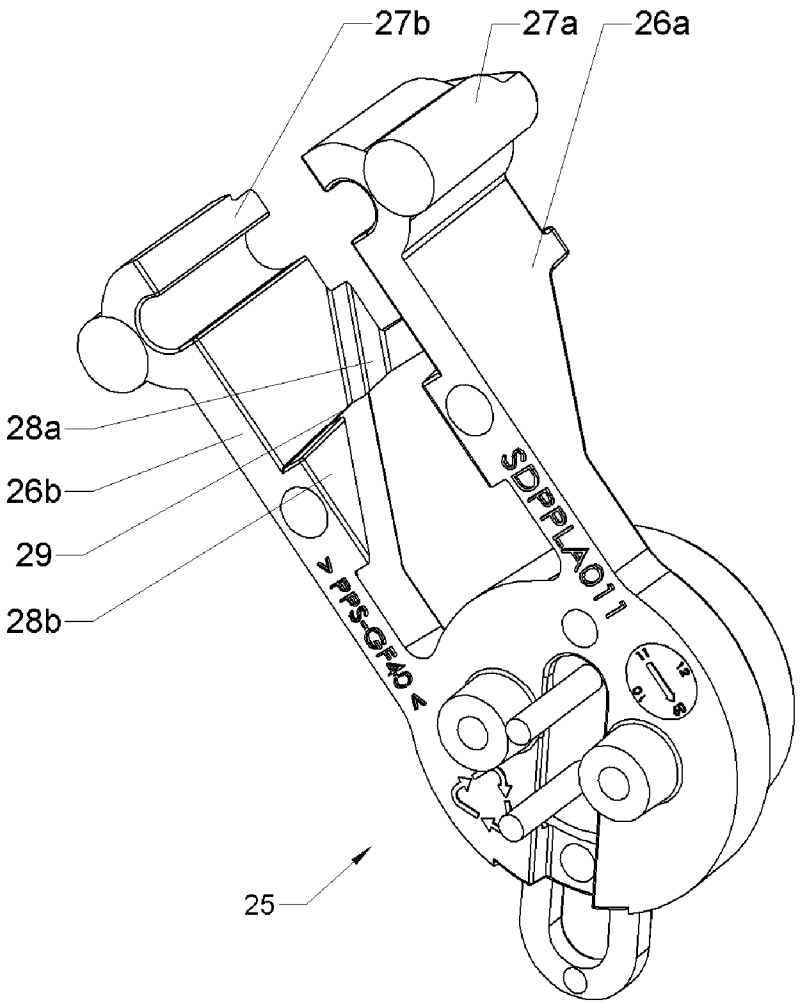
FIG. 6 is a perspective view of the carriage in isolation.

A carriage 25 is provided that couples to the baffle 4. FIGS. 3-5 show the carriage 25 assembled on the baffle 4. FIG. 6 shows the carriage 25 separately for clarity. The carriage 25 comprises a lamp base 9 for lamp 14 retention and two parallel arm extensions 26*a*, 26*b*. A lamp 14 is installed in the lamp base 9 during assembly such that it protrudes through the baffle aperture 22 and reflector aperture 23, and disposed within the reflector 6.

At the distil end of each arm extension 26*a*, 26*b* is disposed a half cylinder 27*a*, 27*b* respectively for slidably engaging with a respective rail 24*a*, 24*b* of the carriage guide 24. The half cylinders 27*a*, 27*b* form a coupling for slidably coupling the carriage 25 to the baffle 4 via the carriage guide 24. The carriage 25 can move freely backwards and forwards in the longitudinal direction L on the carriage guide 24. During operation, the carriage 25 can move away from and towards the baffle 4 in a longitudinal direction to position the lamp 14 at the desired location within the reflector 6 and housing 30. Movement of the carriage 25 can therefore adjust the peak/flat of the lighting apparatus by appropriate positioning of the lamp 14.

Referring back to FIG. 2, the carriages 25 moved forward and backwards along the guide in a longitudinal direction by way of an adjustment force that is generated along a different axis to the longitudinal direction L. The adjustment force is preferably provided by way of a cap screw 40. Rotation of the cap screw 40 in the different axis creates a force that is transferred by a force diverter into a force in the longitudinal direction (longitudinal force) to adjust the position of the carriage 25.

Preferably, the force diverter comprises at least two angled surfaces that slidably bear against each other whereby force applied in the first direction directly or indirectly to the first angled surface is transferred through the bearing surface to the second angled surface. This translates the force in the first direction to a force in the longitudinal direction L. In a preferred embodiment, to enable movement of the carriage 25 in two directions, there are at least two pairs of angled surfaces. The first pair bear against each other to translate a force to act towards the front of the lighting apparatus in the longitudinal direction L, and a second pair that bear against each other to translate a force to act in an opposite direction (backwards away from the front of the lighting apparatus) along the longitudinal direction L.

Figure 7:
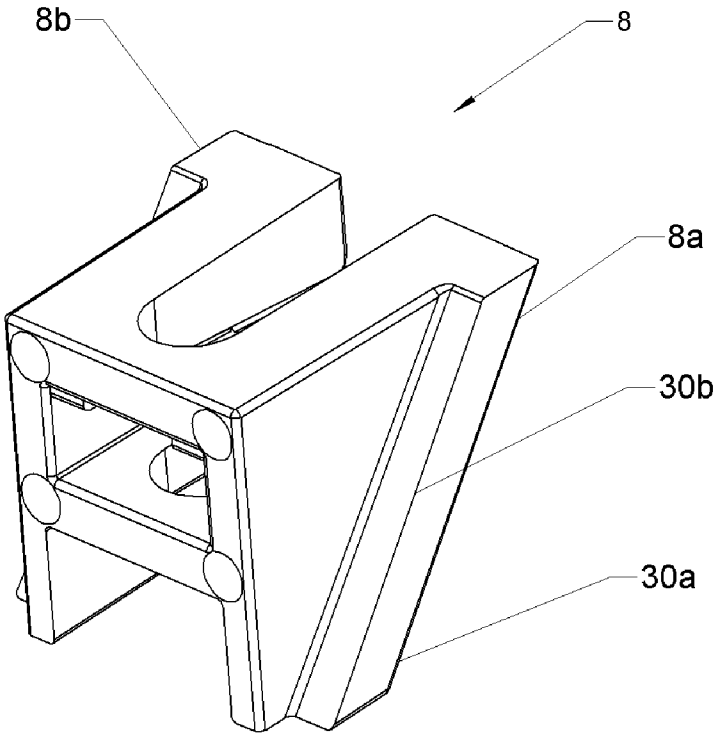
FIG. 7 is a perspective view of the lamp ramp in isolation.

Preferably, the force diverter comprises:

a) as shown in FIG. 7, a lamp ramp 8 with at least one elongated angled protrusions. In this example two protrusions 8*a*, 8*b* on the outer opposite sides of the lamp ramp 8 each provide two bearing surfaces (e.g. 30*a*, 30*b*) facing in opposite directions, and b) on the internal face of each extension 26*a*, 26*b* two opposed angled protrusions 28*a*, 28*b* that define a channel 29. One set of angled protrusions 28*a*, 28*b* is shown in FIG. 6.

The elongated protrusions 8*a*, 8*b* of the lamp ramp are inserted in and slidably retained within the respective channels 29 of each extension 26*a*, 26*b*. The lamp ramp 8 can slide freely relative (at an angle) to the carriage 25 under coercion on the bearing surfaces. The lamp ramp 8 is an insert for the carriage 25.

It will be appreciated that other types of force diverter means, also including other types or configurations of ramps could achieve the same purpose.

The lamp ramp 8 comprises a threaded portion (not shown) for rotatably receiving the cap screw 40. Rotation of the cap screw 40 in a first direction forces the lamp ramp 8 upwards relative to the carriage 25. As the lamp ramp 8 slides, its angled surface e.g. 30*a*, 30*b* bears against the corresponding surface 28*a*, 28*b* on the protrusions in the carriage 25. This transfers the force at right angles in a longitudinal direction and in turn coerces the carriage 25 in a longitudinal direction away from the back of the baffle 4. Rotating the cap screw 40 in the opposite direction by the same mechanism coerces the carriage 4 towards the baffle 4. These movements adjust the relative position of the lamp 14 in the reflector 6.

The peak/flat adjustment assembly can comprise some or all of the baffle, rail system, lamp, carriage, force diverter, lamp ramp and/or cap screw. Preferably, the peak/flat adjustment assembly at least comprises the carriage for coupling to the baffle.

The invention claimed is:

1. A lighting apparatus comprising:

a housing, the housing being elongated with a longitudinal direction and having a back plate, wherein the back plate comprises a plurality of guide rails, a lamp reflector and a reflector holder retained within the housing, a carriage coupled to the housing, the carriage adapted to retain a lamp within the housing, the carriage being moveable relative to the back plate along the longitudinal direction to manipulate the position of the lamp within the housing, wherein the carriage is moveable along a first axis by way of a force applied along a second axis, wherein the carriage comprises a plurality of arm extensions and the carriage is coupled to the housing via at least two of the guide rails, each of which engages a respective arm extension of the carriage, the carriage being moveable relative to the back plate along the guide rails; and, wherein the carriage comprises a force diverter for each said arm extension for transferring a force along the second axis into a force in the longitudinal direction to move the carriage in the longitudinal direction.

2. A lighting apparatus comprising:

a housing, the housing being elongated with a longitudinal direction and having a back plate, wherein the back plate comprises a plurality of guide rails, a carriage coupled to the housing, the carriage adapted to retain a lamp within the housing, the carriage being moveable relative to the back plate along the longitudinal direction to manipulate the position the lamp within the housing, wherein the carriage is moveable along a first axis by way of a force applied along a second axis, wherein the carriage comprises a plurality of arm extensions and the carriage is coupled to the housing via at least two of the guide rails, each of which engages a respective arm extension of the carriage; the carriage being moveable relative to the back plate along the guide rails;

wherein the carriage comprises a force diverter for each said arm extension for transferring a force along the second axis into a force in the longitudinal direction to move the carriage in the longitudinal direction; wherein the force diverter for each said arm extension comprises a first angled surface that bears against a second angled surface.

3. A lighting apparatus according to claim 2 wherein the second angled surface is disposed on an insert that moves relative to the carriage.

4. A lighting apparatus according to claim 3 wherein the force is applied directly or indirectly to the insert.

* * * * *